United States Patent [19]

Wong

[11] Patent Number: 4,844,210

[45] Date of Patent: Jul. 4, 1989

[54] LINE CLAMP

[75] Inventor: Kwok-Ping Wong, The Colony, Tex.

[73] Assignee: Otis Engineering Corporation, Dallas, Tex.

[21] Appl. No.: 158,540

[22] Filed: Feb. 22, 1988

[51] Int. Cl.[4] ..... B60T 7/12

[52] U.S. Cl. ..... 188/65.1; 74/162; 182/191; 188/67

[58] Field of Search ..... 188/65.1, 67; 182/189, 182/190, 191, 193; 74/162

[56] References Cited

U.S. PATENT DOCUMENTS

| | | | |
|---|---|---|---|
| 2,550,839 | 5/1951 | Martin | 188/65.1 |
| 2,945,563 | 7/1960 | O'Hara | 188/65.1 |
| 3,335,469 | 8/1967 | Shano et al. | 188/65.1 |
| 3,467,224 | 9/1969 | Curtis et al. | 188/65.1 |
| 3,579,752 | 5/1971 | Brwn | 188/67 |
| 4,360,171 | 11/1982 | Reid et al. | 188/65.1 X |
| 4,498,563 | 2/1985 | Trahan | 188/65.1 |
| 4,712,772 | 12/1987 | Negrutsky et al. | 188/65.1 X |

*Primary Examiner*—Andres Kashnikow
*Assistant Examiner*—Matthew L. Graham
*Attorney, Agent, or Firm*—Roland O. Cox

[57] ABSTRACT

Disclosed is a line clamping device which may be remotely and repeatedly operated to clamp line passing through the device. Increasing pressure acting on a piston in the clamp housing moves slips to a position clamping the line while compressing a spring. When pressure on the piston is reduced, the spring moves the slips and piston to back to a position not clamping line.

11 Claims, 1 Drawing Sheet

LINE CLAMP

BACKGROUND OF THE INVENTION

The present invention relates to devices used in the petroleum industry to clamp line. More particularly, this invention relates to a clamping device for wireline, which is pressure operated and may be remotely operated repeatedly to clamp and suspend line and prevent the line with tools from falling into a well.

Many such devices are known which will prevent cut or broken line from falling into and being lost in a well when performing service operations in the well using slick or braided line. Use of such devices can prevent time consuming and costly fishing operations in a well. One example of these devices is covered by U.S. Pat. No. 3,467,224 to W. L. and Billy D. Curtis. This device employs an electric switch to sense a wireline break and uses fluid pressure to move slips into and out of clamping engagement with the line.

U.S. Pat. No. 4,498,563 to Trahan discloses a "WIRELINE CATCHER" having mechanical sensing means admitting pressured fluid to an actuator which moves laterally to clamp the line when the line breaks.

A similar device is disclosed in a patent application entitled "WELL SERVICING SYSTEM", filed in the U.S. Patent and Trademark Office Feb. 1, 1988 for inventors Kwok-Ping Wong and Peter Cowan. This device is remotely operated and utilizes fluid pressure to release slips from a non-clamping position and a compressed spring and fluid pressure to move the slips into clamping position. This clamp may not be operated repeatedly.

SUMMARY OF THE INVENTION

The present invention provides a pressure operated line clamping device, attachable to a wellhead or used in a well servicing lubricator, which has a passage for line thru the clamp housing. Slip segments in the clamp housing are moveable between positions clamping and not clamping the line. Pressure applied to a piston within the housing moves the slip segments into clamping position in response to increased fluid pressure acting on the piston. A spring moves and biases the slip segments to not clamping position and an expander in the housing moves the segments apart when completely in not clamping position.

When there is a need to clamp wireline passing thru the clamp housing, pressure is increased in the conduit supplying pressured fluid to the piston to move the slip segments downwardly off the expander, while compressing a spring, until camming surfaces on the slip segments contact camming surfaces in the housing. Further downward movement of the piston cams the segments inwardly to clamp the line. On release of piston pressure, the compressed spring moves the segments and piston upwardly toward not clamping position. Further upward movement of the segments onto the expander moves the segments further apart and completely into not clamping position.

An object of this invention is to provide an improved pressure operated line clamp device which may be remotely operated repeatedly.

BRIEF DESCRIPTION OF THE DRAWINGS

FIG. 1 is a drawing in partial section showing the clamping device of this invention not clamping line passing through.

FIG. 1 shows a clamp 10 of this invention with line L passing through the clamp. The clamp has a housing 11, which includes bores 11*a*, 11*b* and 11*c*, and threads 11*d* and 11*e*. A piston 12 is slidably mounted in the housing and is sealed in bore 11*b* with resilient seal 13 and in bore 11*c* with resilient seal 14 to form a variable volume pressure chamber 15 with the housing. A conduit (not shown) is connected into housing thread 11*d* to supply pressured fluid from a remote source to housing chamber 15. Positioned in body bore 11*a* by a retaining ring 16 in a groove in the bore is an expander 17.

Figure 2:
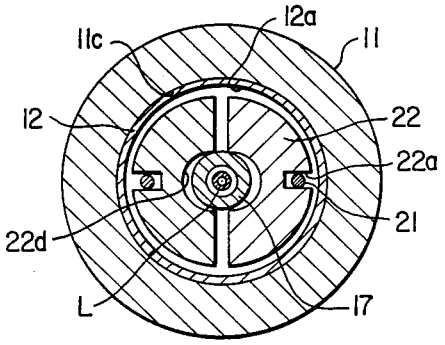
FIG. 2 is a drawing in cross section along line 2—2 of FIG. 1.

The expander has a bore 17*a* and a camming surface 17*b*. A guide 18 is positioned by a retaining ring 19 in a groove in bore 17*a*. Slidably mounted in a piston bore 12*a* is a ring 20 having pins 21 protruding into flange slots 22*a* in each slip segment 22 (see also FIG.2). Pins 21 maintain radial position of the slip segments. Slip segments 22 each have a camming surface 22*b* and teeth are shown cut into friction surface 22*c*. Friction surface 22*c* must be sufficiently rough to stop the line when segments 22 are in clamping position. Sufficient surface roughness may also be obtained by coating or plating surface 22*c*. Connected to housing thread 11*e* is an appropriate connector 23 for connecting clamp 10 to a wellhead or well servicing lubricator. The connector positions lower housing 24 in contact with the lower end of housing 11.

The lower housing has a camming surface 24*a*, which is engageable with segment camming surface 22*b*, a shoulder 24*b*, a thread 24*c* and a bore 24*e*. A set screw 25 is connected in thread 24*c*. This screw may be screwed in by hand to clamp the line. A lower guide 26 is positioned in lower housing bore 24*e* by retaining ring 27 in a groove in bore 24*e*. The upper and lower guides 18 and 26 cooperate to center line being run through the clamp and prevent wear on internal parts of the clamp.

A compressed spring 28 bears on lower housing shoulder 24*b* and pushes ring 20 and slip segments 22 upwardly to a position where expander camming surface 17*b* has entered slip bore 22*d* and moved the segments fully outward to a position not clamping line L.

To operate the clamp of this invention to clamp line L as often as required, pressure in chamber 15 acting on piston 12 is increased sufficiently to move the piston, slip segments 22 and ring 20 downwardly compressing spring 28. Continued piston movement downwardly moves the segments below the end of expander 17 and engaged camming surfaces 22*b* and 24*a* cam the segments inwardly until segment friction surfaces 22*c* seize the outside surface of line L clamping the line to prevent upward or downward movement of the line.

Figure 1:
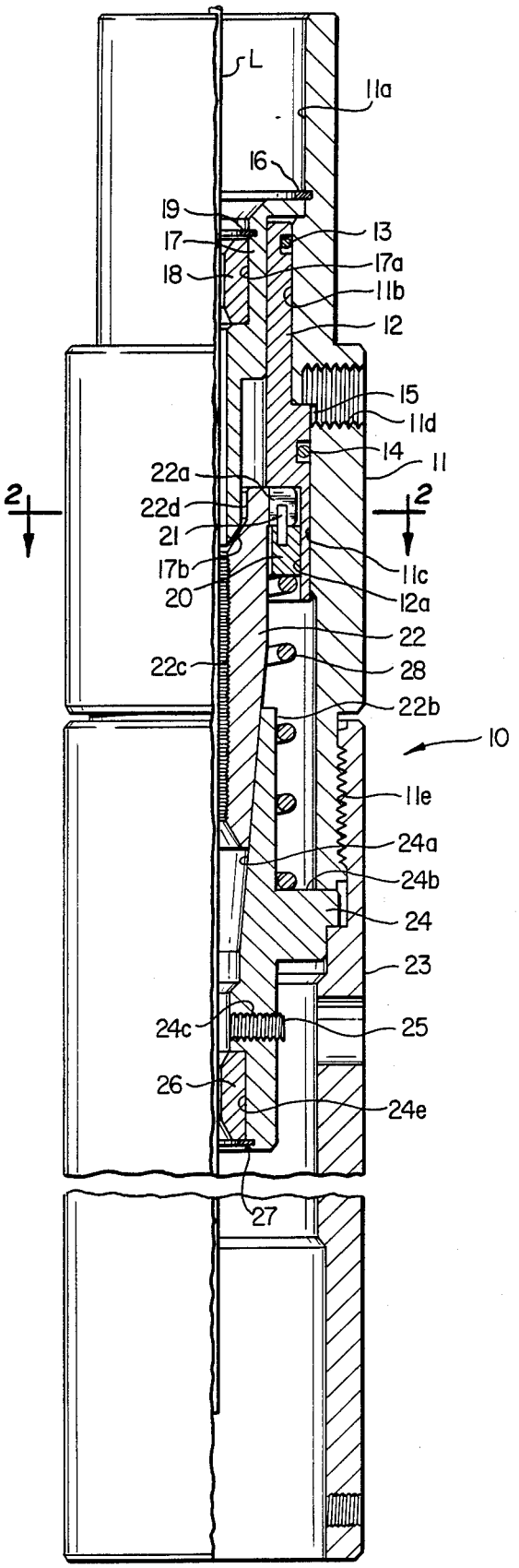
Figure 3:
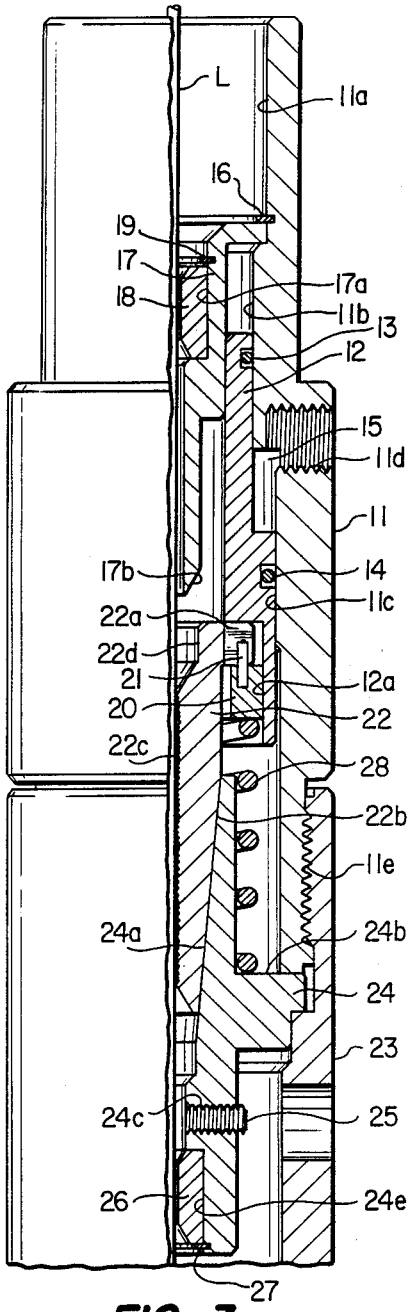
FIG. 3 is a partially sectioned drawing showing the invention device clamping line.

To unclamp the line and allow clamp parts to return to a position not clamping line, pressure in chamber 15 is reduced until spring 28 moves ring 20 and slips 22 upwardly. The slip segments move outwardly along camming surface 24*a* as they travel upwardly unclamping the line. Just before ring 20 and segments 22 have moved completely upward, camming surface 17*b* on the expander enters segment bore 22*d* and cams the segments further outwardly into the position not clamping line as shown in FIG. 1. The line clamp of this invention may now be pressure operated to clamp line again.

What I claim is:

1. A pressure operable clamp having a passage for line therethrough comprising:

(a) a housing having a lower camming surface therein;

(b) means mounted within said housing for clamping line, said means longitudinally moveable from a position not clamping line to a position clamping line, said clamping means including slip segments, each having a bore, a friction surface in said bore, a flange having a slot therethrough and a camming surface thereon engageable with said housing camming surface;

(c) biasing means for biasing said clamping means to the position not clamping line; and (d) pressure responsive means in said housing for moving said clamping means to the position clamping line.

2. The clamp defined in claim 1 wherein each slip segment friction surface has teeth thereon.

3. The clamp as defined in claim 1 wherein the pressure responsive means comprise:

(a) a piston slidably and sealably mounted within said housing, said piston forming a variable volume chamber with said housing; and (b) an inlet in the housing for conducting pressured fluid to said chamber.

4. The clamp as defined in claim 1 including an expander mounted within the housing for moving the slip segments apart when in a position not clamping line.

5. The clamp as defined in claim 4 further including guiding means for guiding and centering the wireline passing through the clamp.

6. The clamp as defined in claim 3 wherein the guiding means comprise:

(a) an upper guide positioned in the expander; and (b) a lower guide positioned in the housing.

7. The clamp as defined in claim 1 wherein the means for clamping line further includes means radially positioning the slip segments.

8. The clamp as defined in claim 7 wherein the radial positioning means comprise:

(a) a ring around the slip segments below the segment flanges; and (b) pins in the ring protruding into the segment flange slots.

9. The clamp as defined in claim 8 wherein the biasing means includes a shoulder in the housing below the ring around the slip segments and a spring mounted between said shoulder and said ring.

10. The clamp as defined in claim 1 wherein the clamp further includes a screw threaded laterally into the housing below the housing camming surface for manually clamping the line.

11. A pressure operable clamp having a passage for line therethrough comprising:

(a) a housing having an expander mounted therein, an upper line guide mounted in said expander, a lower camming surface, a screw threaded laterally into said housing below said camming surface and a lower line guide mounted in said housing;

(b) means mounted within said housing for clamping line, said means longitudinally moveable from a position not clamping line to a position clamping line, said clamping means including slip segments each having a bore, a friction surface in said bore, a flange on each segment and a slot through each flange, a camming surface on each segment engageable with said housing camming surface, means radially positioning said slip segments including a ring around the slip segments below the slip segment flanges and pins in the ring protruding into the segment flange slots;

(c) biasing means for biasing the clamping means to the position not clamping line including a shoulder in the housing below said ring and a spring mounted between said shoulder and said ring; and (d) pressure responsive means mounted in said housing for moving said clamping means to the position clamping line, said means including a piston slidably and sealably mounted in said housing, said piston forming a variable volume pressure chamber with said housing, and an inlet in said housing for conducting pressured fluid to said chamber.

* * * * *